US006032628A

United States Patent [19]

Watanabe et al.

[11] Patent Number: 6,032,628

[45] Date of Patent: Mar. 7, 2000

[54] CAMSHAFT DRIVE FOR FOUR CYCLE OUTBOARD MOTOR

[75] Inventors: Hitoshi Watanabe; Takahide Watanabe; Masanori Takahashi, all of Hamamatsu, Japan

[73] Assignee: Sanshin Kogyo Kabushiki Kaisha, Hamamatsu, Japan

[21] Appl. No.: 09/130,409

[22] Filed: Aug. 6, 1998

[30] Foreign Application Priority Data

Aug. 8, 1997 [JP] Japan ..... 9-214708

[51] Int. Cl.[7] ..... B63H 20/00; F01L 1/02

[52] U.S. Cl. ..... 123/90.31; 123/195 P; 123/195 HC; 440/900

[58] Field of Search ..... 123/90.27, 90.31, 123/195 P, 195 HC, 196 W; 440/900

[56] References Cited

U.S. PATENT DOCUMENTS

| | | | |
|---|---|---|---|
| 5,129,375 | 7/1992 | Takane et al. | 123/90.31 |
| 5,554,060 | 9/1996 | Koishikawa et al. | 440/89 |
| 5,743,228 | 4/1998 | Takahashi | 123/195 P |
| 5,803,036 | 9/1998 | Takahashi et al. | 123/179.25 |
| 5,865,655 | 2/1999 | Hiraoka et al. | 440/89 |
| 5,931,126 | 8/1999 | Eguchi et al. | 123/90.17 |

*Primary Examiner*—Weilun Lo

*Attorney, Agent, or Firm*—Knobbe, Martens, OLlson &Bear llp

[57] ABSTRACT

An outboard motor embodying a twin overhead camshaft, four cycle internal combustion engine as a power plant. The engine has an improved flexible transmitter drive for the camshaft, which permits the drive pulley to overly the end main bearings for the camshafts so as to reduce bending loads on them.

13 Claims, 11 Drawing Sheets

CAMSHAFT DRIVE FOR FOUR CYCLE OUTBOARD MOTOR

BACKGROUND OF THE INVENTION

This invention relates to a cam shaft drive arrangement for a four-cycle engine and more particularly to such a drive arrangement for a four-cycle engine of an outboard motor.

In many four-cycle engines, the cam shaft is driven from the crankshaft by means of a flexible transmitter in the form of a toothed belt. When belt drive cam shaft timing arrangements are employed, the belt is positioned outside of the actual engine body. That is, unlike gear or chain timing mechanisms, the belt should be protected from the engine lubricant and preferably positioned externally of the main engine body. This presents some particular potential difficulties.

That is, because the timing drive belt is positioned externally of the engine, this means that the drive for the cam shaft is spaced from the outermost bearing that supports both the crankshaft and the cam shaft. Thus, bending loads are placed on the cam shaft that can cause high wear to either the bearing and/or the shaft which is borne.

It is, therefore, a principal object of this invention to provide an improved timing belt arrangement for four-cycle internal combustion engines.

It is a still further object of this invention to provide an improved bearing and belt drive arrangement for the cam drive of a four-cycle engine.

The aforenoted problems are particularly acute in conjunction with outboard motors. As is well known, such outboard motors are quite compact in nature. Because of the premium for space, the positioning of the cam shaft drive on the end of the engine, as is necessitated by the use of a drive belt, tends to increase the overall length of the engine. This is particularly undesirable with applications where space is at a premium, such as with an outboard motor application.

These problems are further aggravated when other accessories are driven off of the engine. That is, these further accessory drives can add considerably to the length of the engine.

It is, therefore, a still further object of this invention to provide an improved cam shaft drive arrangement employing a drive belt for use in outboard motors.

SUMMARY OF THE INVENTION

This invention is adapted to be embodied in a cam shaft drive arrangement for an internal combustion engine having an engine body in which a crankshaft and at least one cam shaft are rotatably journaled. The crankshaft and the cam shaft both extend outwardly beyond one end face of the engine body. Drive sprockets are affixed to the extending portions of the cam shaft and crankshaft for accommodating a flexible transmitter for transmitting drive therebetween. At least one of the drive sprockets extends axially relative to its respective shaft so that it overlies a main bearing for the one end of the respective shaft in axial extent.

DETAILED DESCRIPTION OF THE PREFERRED EMBODIMENTS

Figure 1:
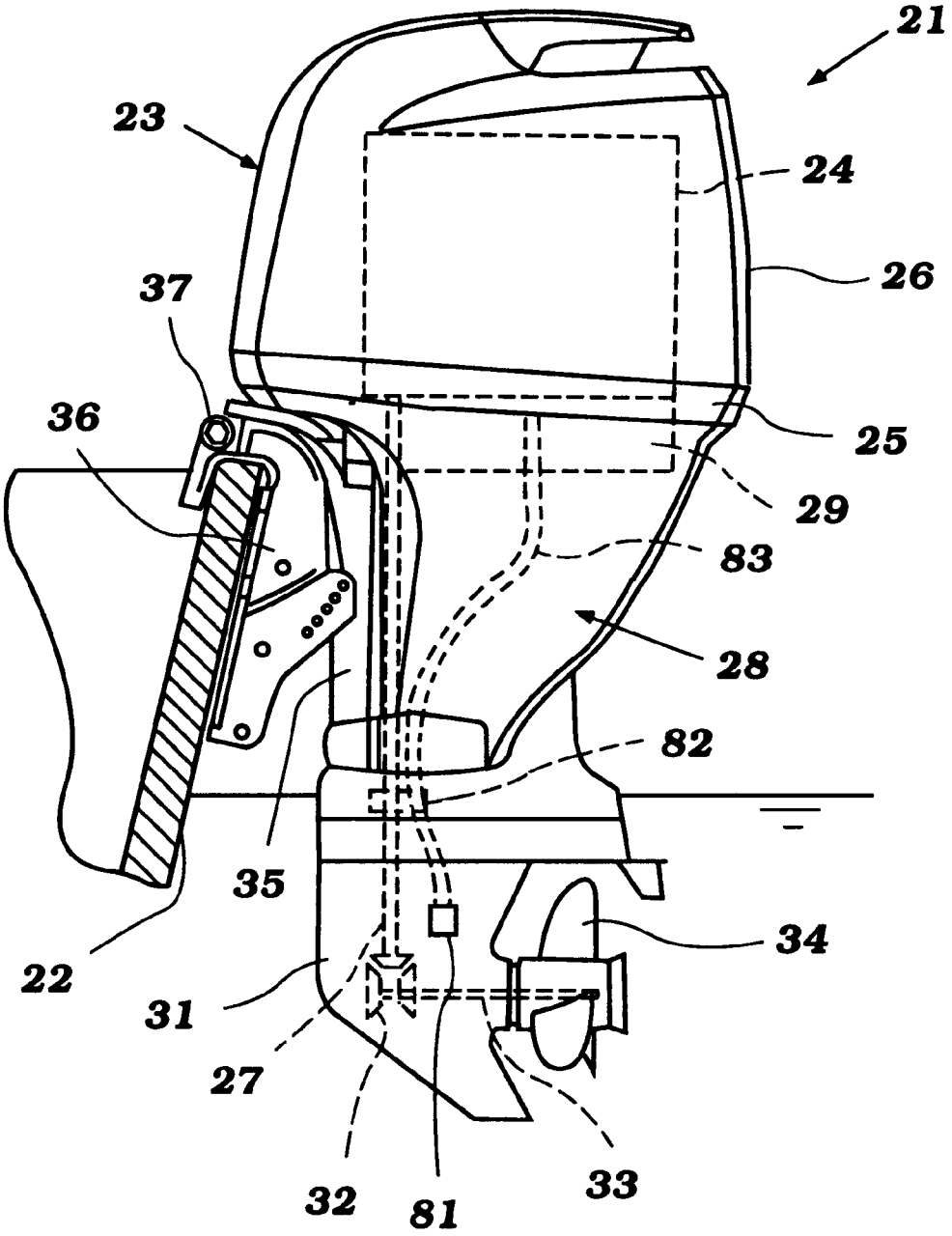
FIG. 1 is a side elevational view of an outboard motor shown attached to the transom of an associated watercraft, which is shown partially and in section.

Referring now in detail to the drawings and initially to FIG. 1, an outboard motor constructed in accordance with an embodiment of the invention is indicated generally by the reference numeral 21. In this Figure, the outboard motor 21 is shown attached to the transom 22 of an associated watercraft which is shown partially and in cross section.

The outboard motor 21 is comprised of a power head assembly 23 that consists primarily of a powering internal combustion engine, shown in phantom in this view and indicated by the reference numeral 24, and a surrounding protective cowling. This protective cowling includes a lower, tray member 25 and an upper, main cowling member 26 that is detachably connected to the tray member 25 in a suitable arrangement.

As will become apparent as the description proceeds, the engine 24 is mounted in the power head 23 so that its crankshaft (not shown in this figure but which will be described later) rotates about a vertically extending axis. This is typical with outboard motor practice and is done so as to facilitate the connection to a drive shaft 27 which depends into a drive shaft housing lower unit assembly, indicated generally by the reference numeral 28. An exhaust guide 29 and support plate is provided at the upper end of the drive shaft housing 28 and the engine 24 is mounted upon it.

In a lower unit portion 31 of the drive shaft housing and lower unit assembly 28, there is provided a conventional forward neutral reverse bevel gear transmission, indicated generally by the reference numeral 32. This transmission 32 is adapted to drive a propeller shaft 33 that is mounted in the lower unit 31 and to which a propeller 34 is attached. This forward neutral reverse transmission 32 permits selection of the drive of the propeller 34 in forward or reverse propulsion mode or in a neutral condition in which the propeller 34 is not driven.

The drive shaft housing lower unit assembly 28 has affixed to it a steering shaft which is not shown in this figure, but which is mounted for steering movement in a swivel bracket 35 in a manner that is well known in this art. The swivel bracket 35 is, in turn, connected to a clamping bracket 36 by means that include a pivot pin 37 for tilt and trim movement of the outboard motor 21 in a manner which is also well known in this art.

Further details of the construction of the outboard motor 21 except for the engine 24 and its valve train are not believed necessary to permit those skilled in the art to practice the invention. For that reason, any components of the outboard motor 21 which have not been described or illustrated may be considered to be conventional or any known constructions may be employed to practice the invention.

The construction of the engine 24 will now be described by primary reference to FIGS. 2–6. The engine 24 is comprised of a body made up of three major components comprised of a cylinder block 37, a cylinder head assembly 38 and a crankcase member 39 which are connected together in any known manner.

Figure 3:
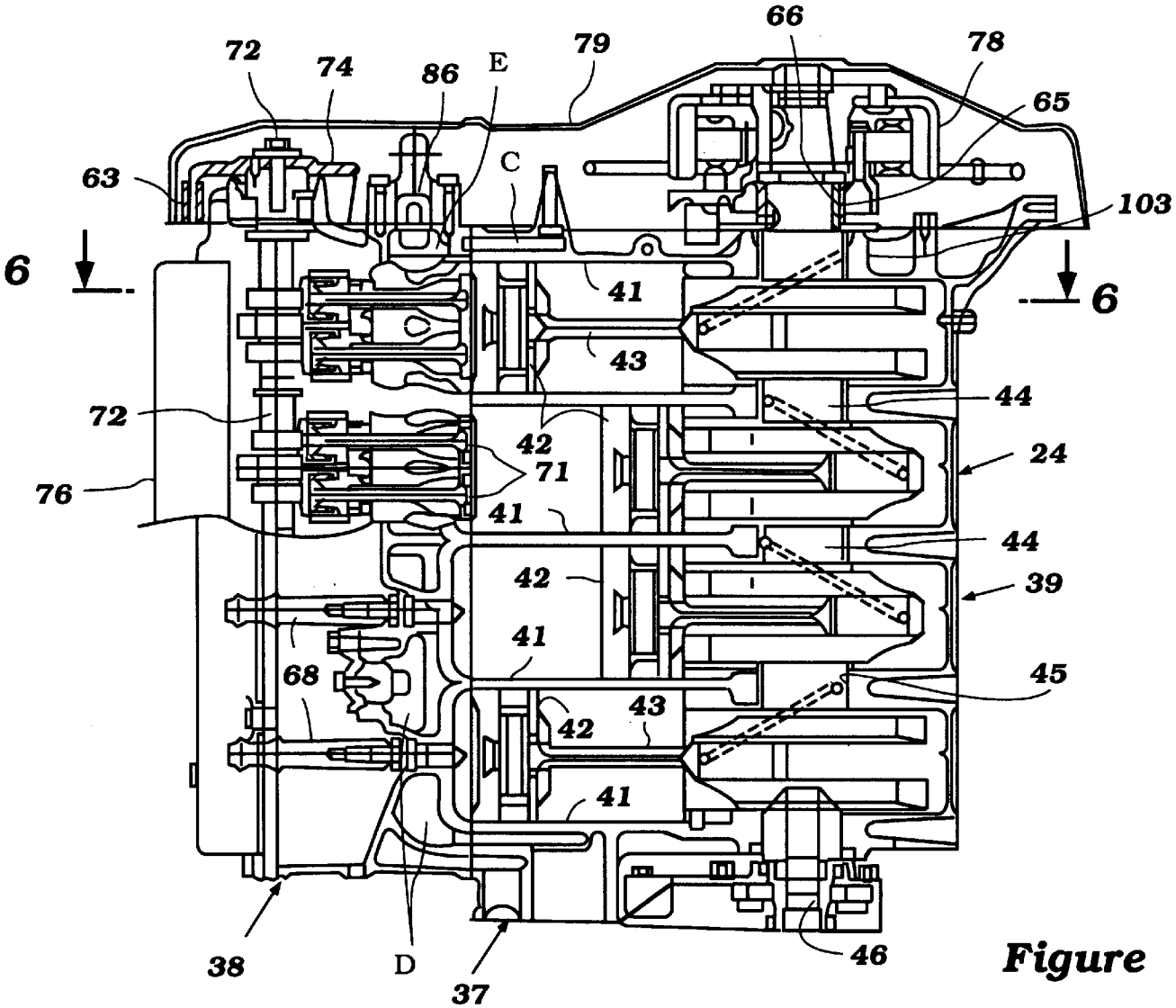
FIG. 3 is a view looking in the same direction as FIG. 2 showing only the engine and with portions of it broken away and shown in section.

As may be best seen in FIG. 3, the cylinder block 38 is formed with four vertically spaced, horizontally extending, cylinder bores 41. These cylinder bores 41 may be formed as liners or plated coatings in the cylinder block 37 which is formed primarily from a light alloy.

Pistons 42 are supported for reciprocation in the cylinder bores 41. These pistons 42 are connected by means of piston pins to the small ends of connecting rods 43. Each connecting rod 43 is journaled on a respective throw of the aforementioned crankshaft which appears in this and other figures and which is indicated generally by the reference numeral 44.

Although the invention is described in conjunction with a four-cylinder engine, it should be readily apparent to those skilled in the art how the invention can be employed with engines having other numbers of cylinders and also how the invention can be employed with engines in which the cylinders are disposed at an angle to each other such as with V-type engines.

The crankshaft 44 is journaled within a crankcase chamber that is formed by the cylinder block 37 and the crankcase member 39. This journalling is accomplished by means of bearing surfaces 45 which may be formed integrally with the crankcase member 39 and which cooperate with like bearing surfaces formed in the cylinder block 37. Of course, other arrangements are possible for the journalling of the crankshaft 44, as will become readily apparent to those skilled in the art. The configuration of the upper main bearing and its relation to the cam shaft drive mechanism (to be described later) is important to the invention and is not as in the prior art.

As may be seen in FIG. 3, the lower end of the crankshaft 44 is provided with a splined opening 46 so as to receive the upper end of the drive shaft 27.

Figure 6:
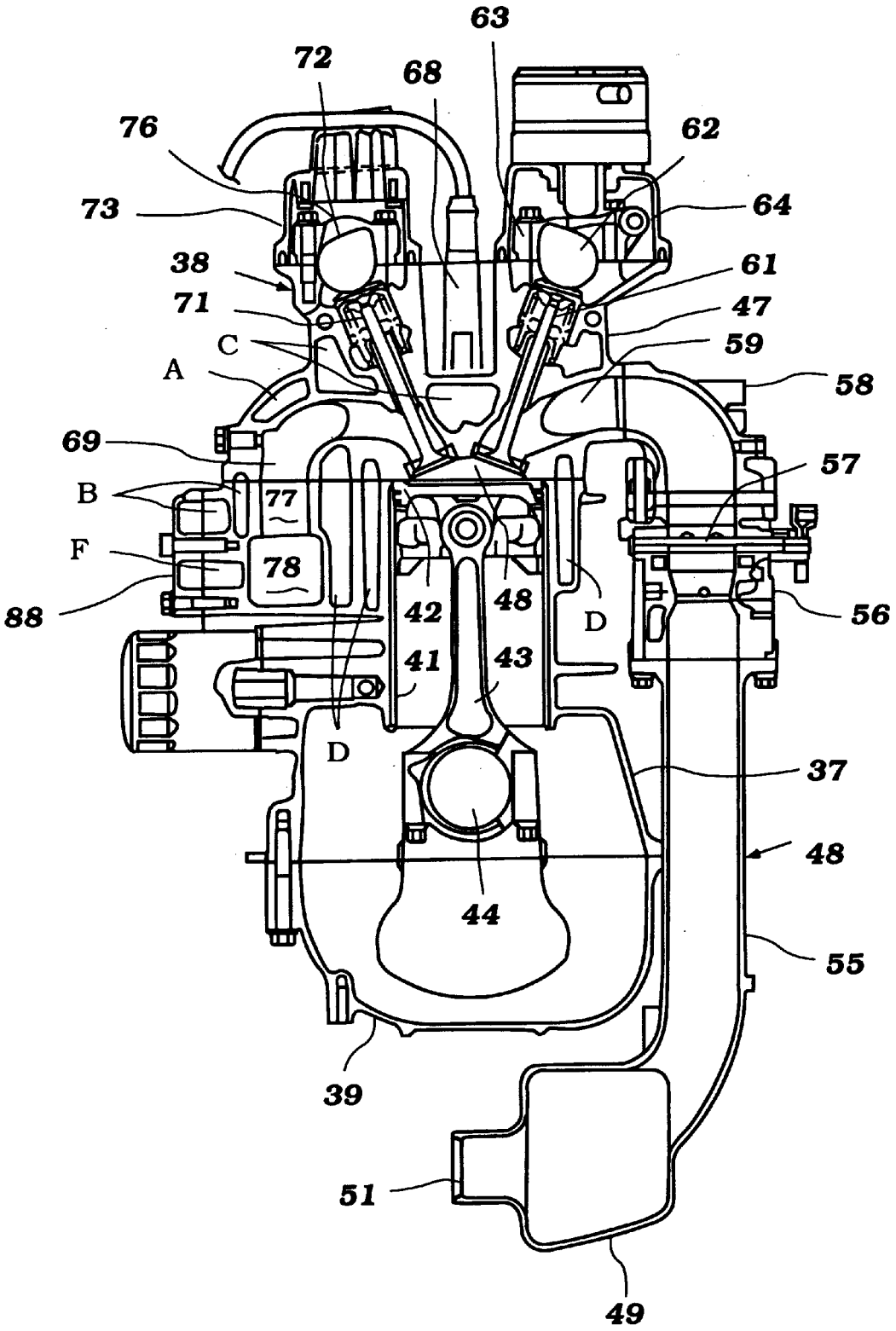
FIG. 6 is a cross-sectional view taken along the line 6—6 of FIG. 3.

Referring now primarily to FIGS. 3 and 6, it will be seen that the cylinder head assembly 38 is formed by a main cylinder head member 47 that has individual recesses 48 formed in its lower surface which cooperate with the cylinder bores 41 and pistons 42 so as to form the individual combustion chamber to the engine.

An intake charge is delivered to these combustion chambers by an induction system that is indicated generally by the reference numeral 48. This induction system, in the illustrated embodiment, is comprised of an air inlet and silencing device 49 mounted adjacent the forward end of the forwardmost surface of the crankcase member 39. An air inlet opening 51 permits air to be drawn into this silencing device from within the protective cowling.

Air is delivered to the interior of the protective cowling by means of a rearwardly facing air inlet opening 52 that is formed in the top of the rear portion of the main cowling member 26. This permits air to be drawn into a chamber 53 for introduction to the interior of the protective cowling through a pair of transversely spaced apart, upwardly extending inlet openings 54. This configuration facilitates the removal or separation of water from the inducted air.

The air collected in the air inlet device 49 is then delivered through a plurality of runner sections 55 to throttle body assemblies 56 in which flow controlling throttle valves 57 are positioned. These throttle valves 57 are operated by a suitable linkage system so as to control the speed of the engine 24 in a manner well known in this art.

The throttle bodies 56 communicate at their downstream ends with an intake manifold 58 which, in turn, forms a portion of the cylinder head assembly 38 and delivers the air charge to intake passages 59 formed in the main cylinder head member 47.

These intake passages 59 terminate at valve seats which are valved by poppet type intake valves 61. In the illustrated embodiment, there are provided two intake valve seats and two intake valve 61 for each cylinder bore 41. Obviously, other types and numbers of valve arrangements may be employed.

The intake valve 61 are urged to their closed positions by means of a suitable spring and keeper arrangement. An intake camshaft 62 is journaled in the cylinder head assembly 38 by means that include bearing caps 63 and which will be described in more detail later. The intake camshaft 62 has cam lobes that open the intake valves 61 in a manner well known in the art. A cam cover 64 also forms a portion of the cylinder head assembly 38 and encloses the cam chamber in which the intake camshaft 62 rotates.

Figure 4:
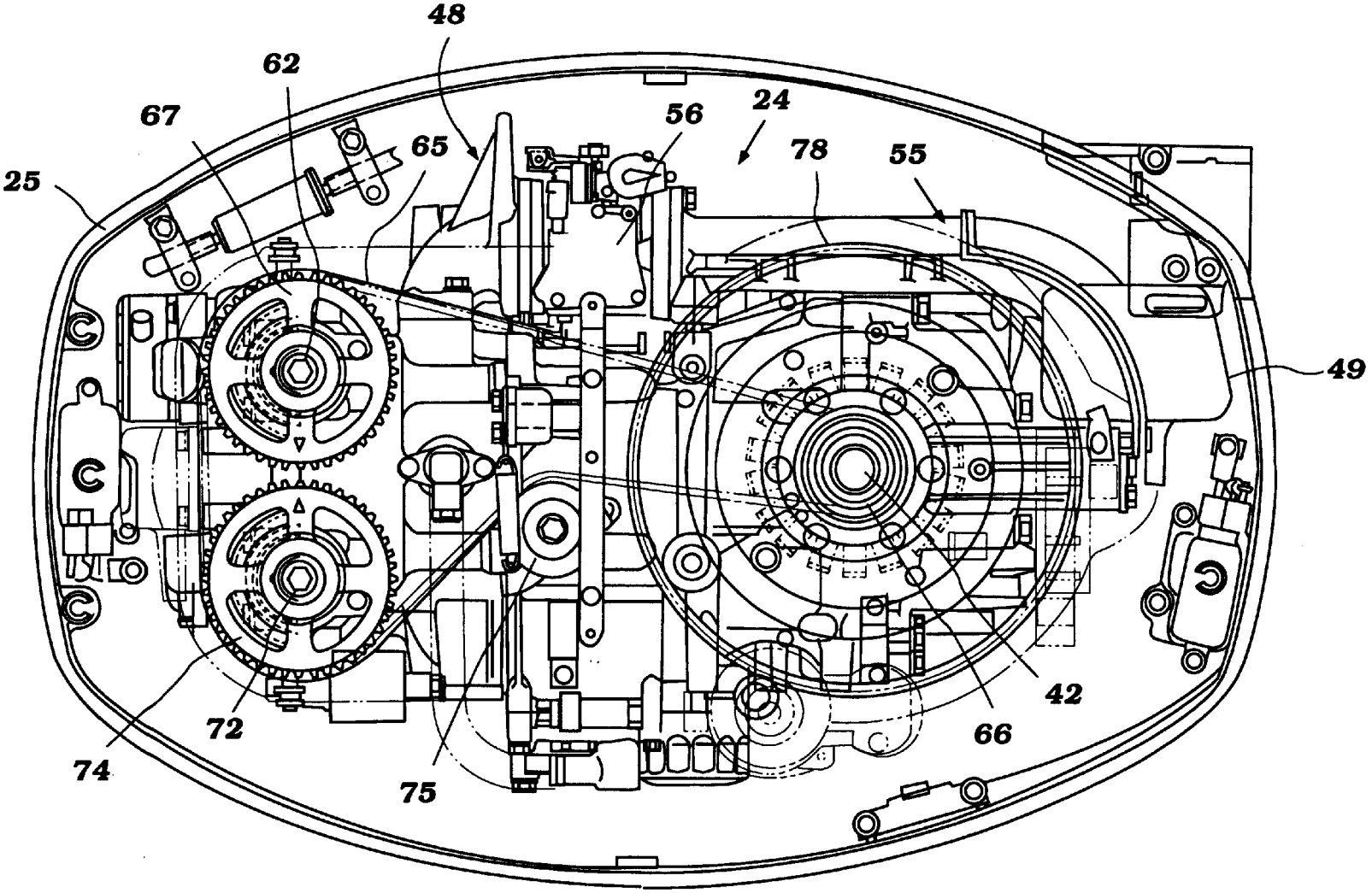
FIG. 4 is a top plan view of the power head with the main cowling and engine cover removed to show more clearly the structure of the engine.
Figure 5:
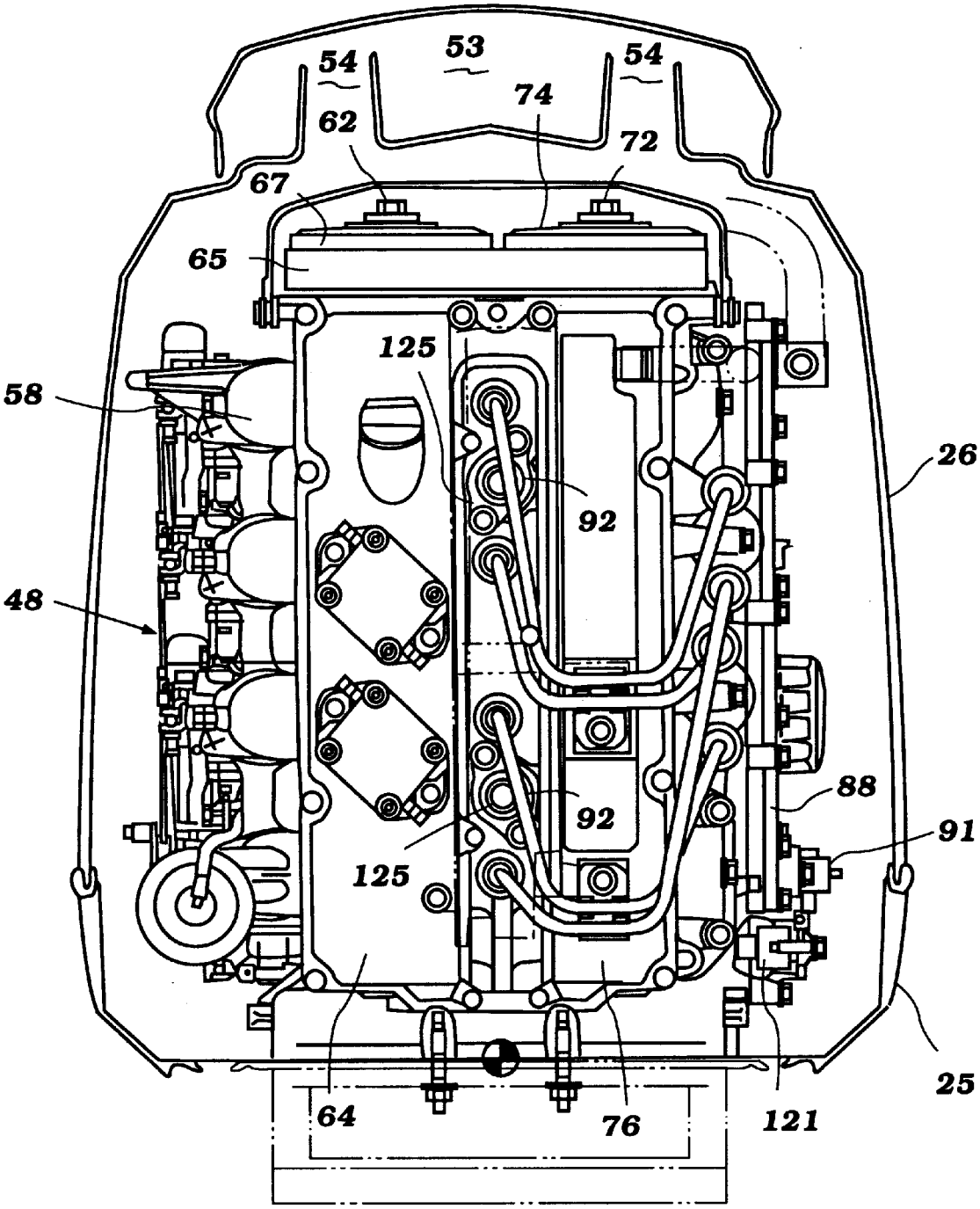
FIG. 5 is a rear elevational view of the power head showing the protective cowling broken away.

As best seen in FIG. 4, the intake camshaft 62 is driven at one-half crankshaft speed by means of a drive that includes a flexible transmitter such as a toothed belt 65. This belt is driven by a driving sprocket 66 that is fixed to the crankshaft 42 near its upper end. This belt, in turn, drives a driven sprocket 67 that is fixed to the upper end of the intake camshaft 62. The details of this construction and remainder of the cam drive will be described later.

Fuel is supplied to the combustion chambers of the engine through a suitable fuel charging system. This may be comprised of either carburetors, which can be formed as a part of the throttle bodies 56 or by means of fuel injectors. The fuel injectors may be manifold injectors that inject fuel into the induction system 48 at a suitable location. Alternatively, direct cylinder fuel injection may be employed. Since the method of fuel charge forming forms no part of the invention, it has not been illustrated nor is further description believed to be necessary to permit those skilled in the art to practice the invention.

Spark plugs 68 are mounted in the cylinder head assembly 38 and have their spark gaps extending into the combustion chamber recesses 48 of the cylinder head member 47. These spark plugs 68 are fired by a suitable ignition system.

The charge which is ignited by the spark plugs 68 will burn and expand to drive the pistons 42 downwardly in the cylinder bores 41. This motion is then transmitted, as aforenoted, through the connecting rods 43 to the crankshaft 44 to drive it.

The burnt charge is discharged from the combustion chambers through an exhaust system which includes cylinder head exhaust passages 69 which are formed in the cylinder head member 47 on the side opposite the intake passages 59. Like the induction system, the exhaust system may employ two valves per cylinder that valve the valve seats formed at the cylinder head recessed portion 48 of the intake passages 69. These exhaust valves are indicated by the reference numeral 71 and are urged to their closed positions in any suitable manner.

An exhaust cam shaft 72 is journaled in the cylinder head assembly 38 in a manner which includes bearing caps 73 and will also be described in more detail later. Like the intake camshaft 62, the exhaust camshaft 72 extends through an upper wall of the cylinder head assembly and has a driving sprocket 74 affixed to this end. The timing belt 65 also is entrained around this sprocket 74 and drives it at one-half crankshaft speed.

The return flight of the driving belt 65 is entrained around an idler sprocket 75 that is mounted on the upper side of the cylinder block 37 and which includes an arrangement to tension the drive belt 65. This will also be described in more detail later.

Like the intake camshaft 62, the exhaust camshaft 72 is enclosed by a cam cover 76 that is affixed to the main cylinder head member 47 in any known manner.

The exhaust passages 69 terminate in a forwardly facing surface of the cylinder head member 47 that is spaced transversely outwardly from the cylinder bores 41. This terminal ends of the exhaust passages 69 communicates with inlet runners 77 of an exhaust manifold that is formed in the cylinder block 37. This exhaust manifold includes a vertically extending collector section 78.

The lower end of this collector section 78 communicates with an exhaust passage formed in the exhaust guide plate 29. A suitable exhaust system is provided in the drive shaft housing and lower unit 28 for discharging these exhaust gases to the atmosphere. This exhaust system may include, as is typical with outboard motor practice, a high-speed underwater exhaust gas discharge and a low speed above the water exhaust gas discharge.

Figure 2:
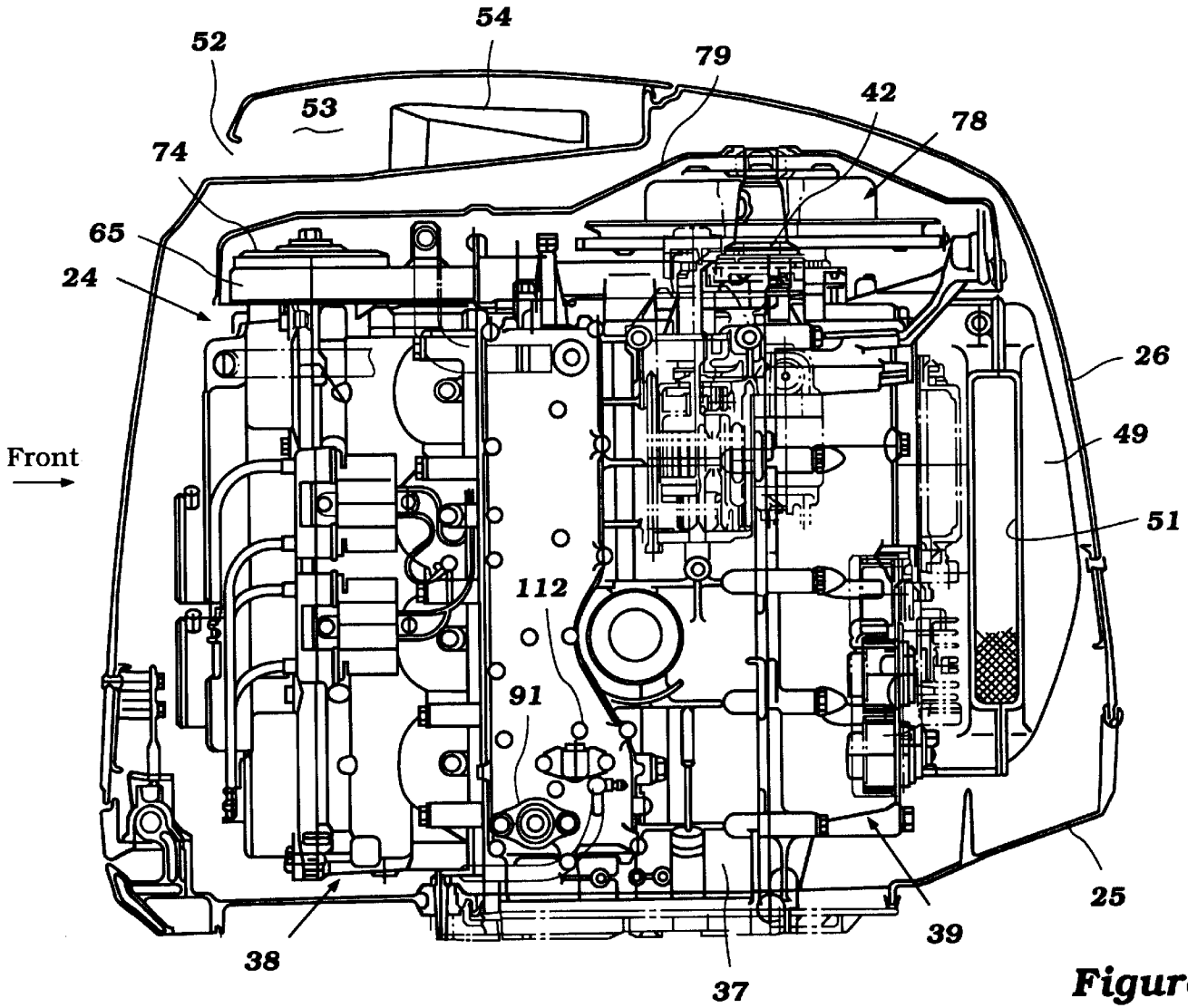
FIG. 2 is an enlarged side elevational view of the power head, looking in the direction opposite to that of FIG. 1 and with the protecting cowling shown in cross section to illustrate the external configuration of the engine.

As may be best seen in FIGS. 2–4, a flywheel magneto assembly, indicated generally by the reference numeral 78, is affixed to the upper end of the crankshaft 42 at a point above the timing drive belt 65 for the intake and exhaust camshafts 62 and 72. A starter motor (not shown) may be associated with the flywheel for starting of the engine. This assembly including the timing drive is covered by an engine cover plate 79 that is affixed to the upper side of the engine in any suitable manner.

The engine 24 is water cooled and that system will be described briefly. Referring first to FIG. 1, it should be seen that the lower unit portion 31 is formed with a water inlet opening 81 that is disposed so that it will be under the level of water under all running conditions of the watercraft. As is typical with outboard motor practice, water is drawn through the inlet opening 81 by a water pump 82. The water pump 82 is driven off of the lower end of the drive shaft 27 at a point where the drive shaft housing and lower unit portions meet.

The water pump 82 delivers the water upwardly to the engine cooling jackets through a conduit indicated at 83. These cooling jackets include a cylinder block cooling jacket 84 and a cylinder head cooling jacket 85.

The portions of the exhaust manifold that are formed in the engine body are also encircled by the respective cooling jackets, including a manifold cooling jacket formed in the cylinder block and cylinder head and designated by the same reference numerals as applied to the main cooling jackets of these two engine body members.

At the outlet of these cooling jackets and specifically the cylinder head cooling jacket, there is provided a thermostat 86. When open, the thermostat 86 permits the water to be discharged from the engine cooling jackets back to the body of water in which the watercraft is operating. Some of this coolant may also be mixed with the exhaust gases to assist in their cooling and the silencing of them.

The mechanism for driving the cam shafts 62 and 72 will now be described in more detail as will the bearing arrangements for the upper ends of these cam shafts and also for the upper end of the crankshaft 44.

A first arrangement for journalling the upper ends of the intake and exhaust cam shaft 62 and 72 will be described by particular reference to FIGS. 7–10. It has been noted previously that the journalling of the intake cam shaft 62 was by bearing caps 63 and the journalling of the exhaust cam shaft 72 was by bearing caps 73. This is true along the length of each of these cam shafts except for the uppermost main bearings.

Figure 7:
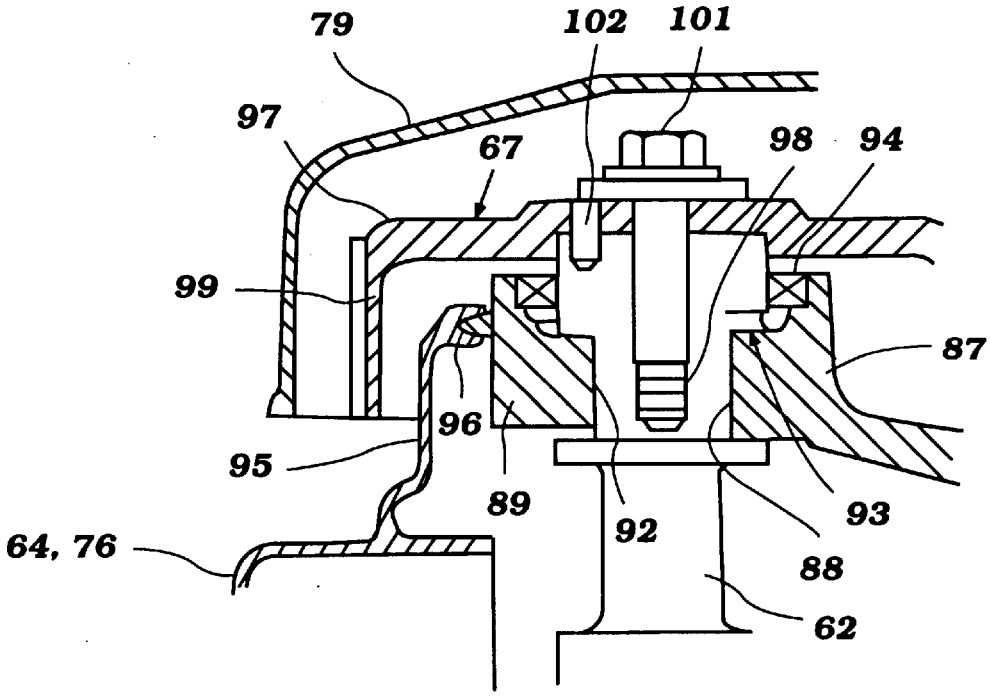
FIG. 7 is a further enlarged cross-sectional view looking in the same direction as FIG. 3 and showing in more detail the bearing and drive arrangement for the cam shafts.
Figure 8:
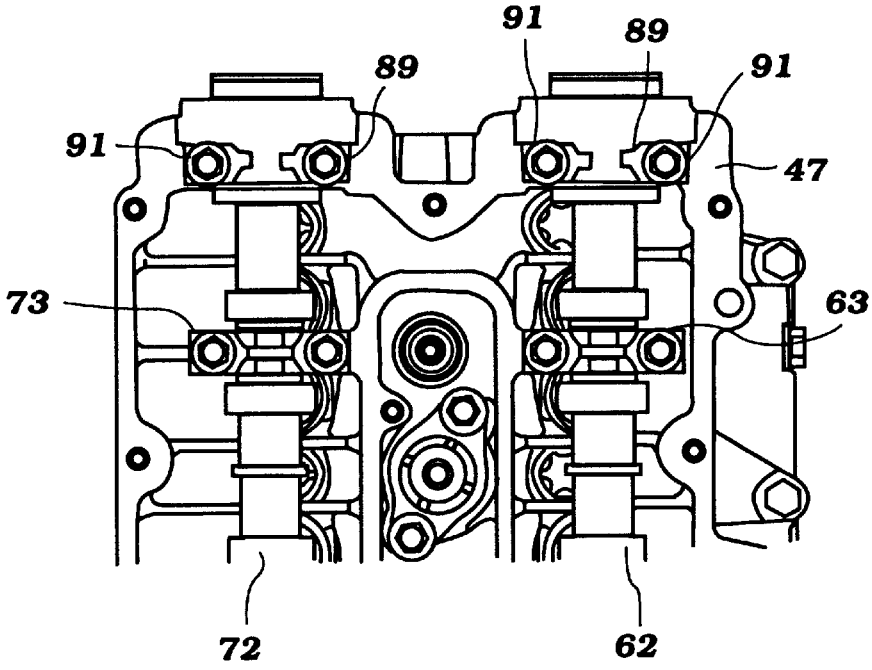
FIG. 8 is an enlarged view looking in the same direction as FIG. 5 but with the cam cover removed and the cam drive mechanism removed so as to more clearly show the bearing arrangement for the cam shafts.
Figure 9:
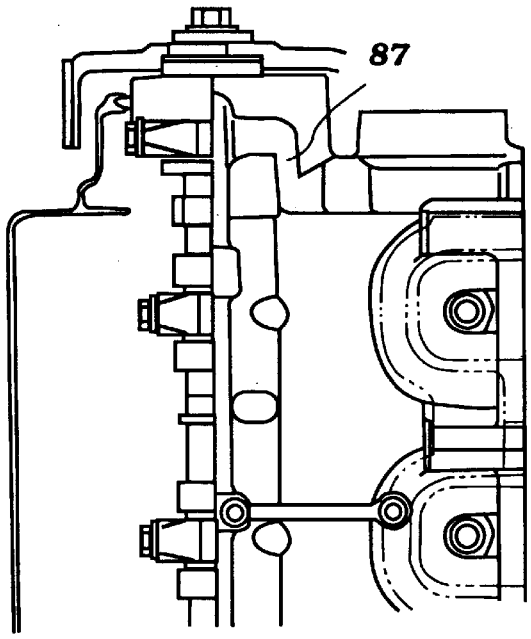
FIG. 9 is a view looking in the direction transverse to that of FIG. 8 and showing the same structure. In this figure, however, the drive sprocket for the cam shaft is shown and thus this view is in part similar to FIG. 7 but on a reduced scale from that figure.
Figure 10:
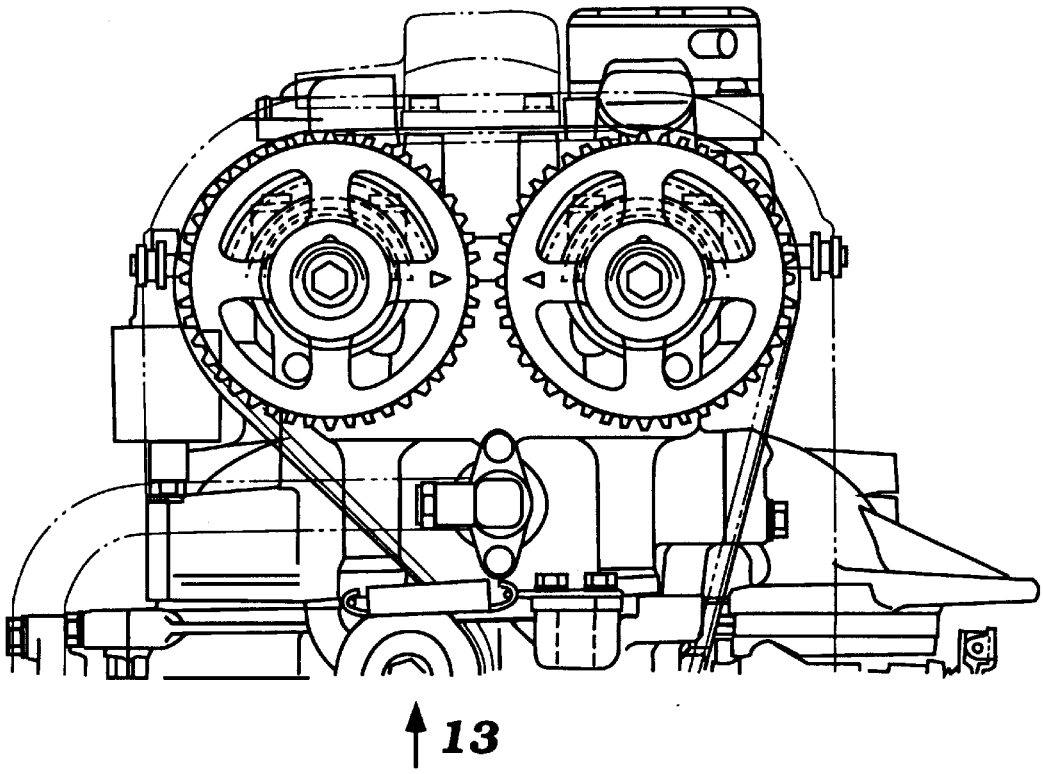
FIG. 10 is a top plan view looking in the same direction as FIG. 4 but on an enlarged scale and showing only the cam shaft drive arrangement and the partial relationship to the belt tensioner.

These upper main bearings appear in FIGS. 7–9 and are comprised of integral bearing surfaces formed in nose pieces 87 of the uppermost edge of the cylinder head member 47. These nose piece bearing surfaces are indicated at 88 in FIG. 7.

A specially formed bearing cap 89 is affixed over this bearing surface 88 by threaded fasteners 91. This bearing cap 89 has a bearing surface 92 that is complementary to the nose piece bearing surface 88 and which journals the upper end portion of the intake cam shaft 62. It will be seen that this bearing portion is defined at its upper end by a recess 93 in which an oil seal 94 is provided.

A similar bearing arrangement is provided for the exhaust cam shaft 72. Therefore, where components of this bearing arrangement appear in the drawings, they have been identified by the same reference numeral.

It should be seen also that the cam cover 64 and 76 or single cam cover if that type of arrangement is employed have nose portions 94 that overlie the nose portions 87 of the cylinder head member 47. An oil seal 95 is provided between these nose portions 94 and the respective bearing caps 89.

As may be seen primarily in FIG. 7, the driving sprocket 67 for the intake cam shaft 62 is provided with an end portion 97 that is abuttingly engaged with an enlarged end part 98 of the cam shaft 62. The toothed portion, indicated by the reference numeral 99 extends downwardly and axially overlaps the nose portion 95 of the cam cover 64, 76, and thus keeps the load of the driving belt on the portion of the cam shaft 62 that is journaled in the bearing surfaces 88 and 92. Hence, no bending loads are applied to the cam shaft as is true with the cantilever-type arrangements employed in the prior art.

A threaded fastener 101 secures the driving sprocket 67 to the cam shaft 62 while a locating key 102 will ensure the driving relationship.

As may be best seen in FIG. 3, this bearing arrangement also permits the driving sprocket 66 of the crankshaft 44 to be disposed immediately adjacent an upper main bearing 103 therefore that is formed like the other main bearings by the cylinder block body 37 and the crankcase member 39. This not only minimizes bending loads on the crankshaft but permits the crankshaft and cam shafts to be maintained in a very short length.

Figure 11:
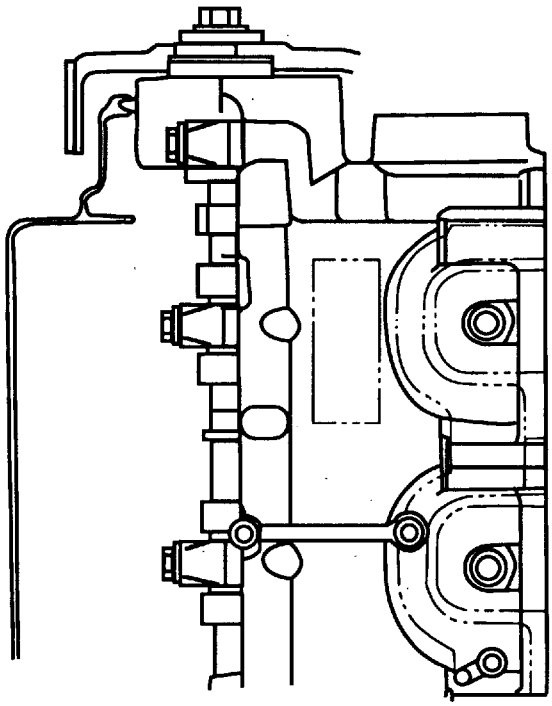
FIG. 11 is a view, in part similar to FIG. 9, and shows another embodiment of the invention.
Figure 12:
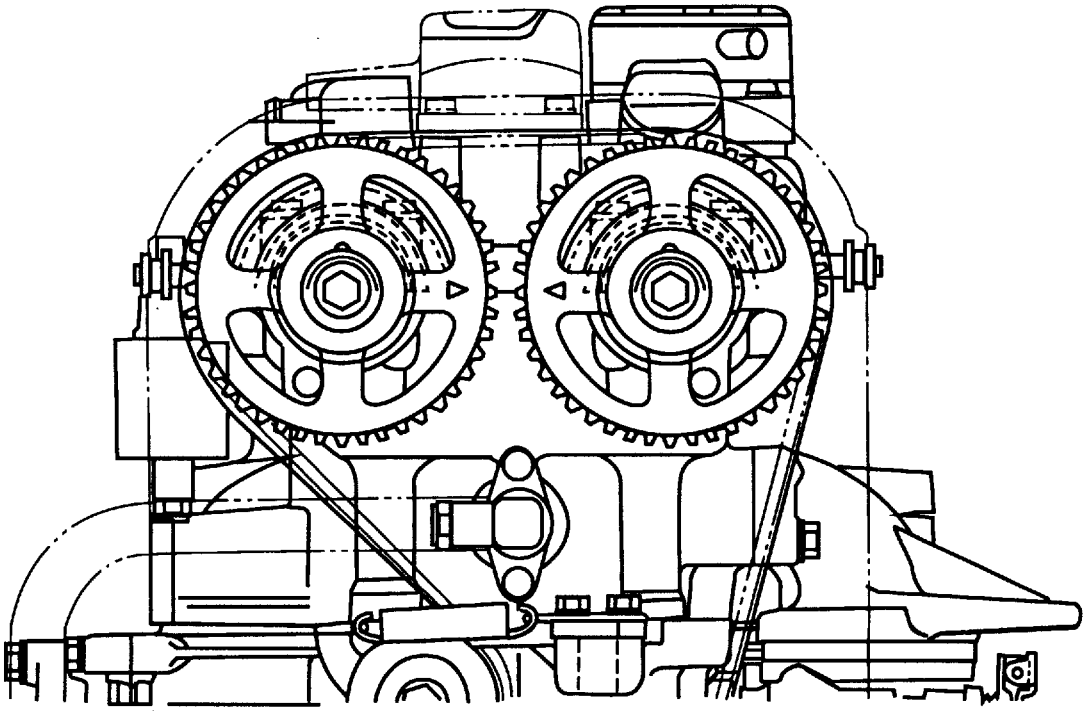
FIG. 12 is a view in part similar to FIG. 10 but showing the construction associated with this embodiment.
Figure 13:
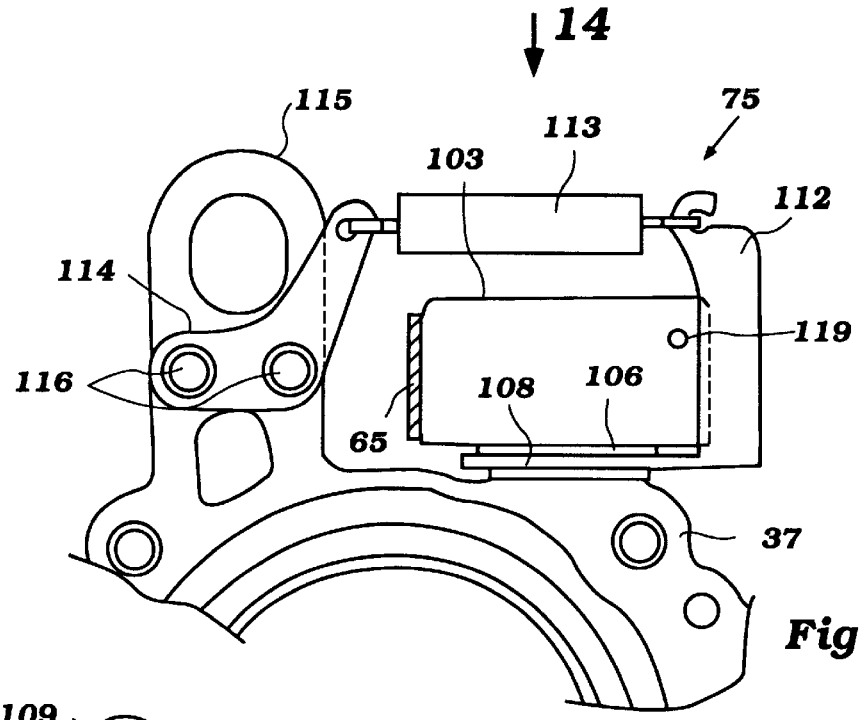
FIG. 13 is a view of the idler tensioner mechanism and is taken looking in the direction of the arrow 13 in FIG. 10.
Figure 15:
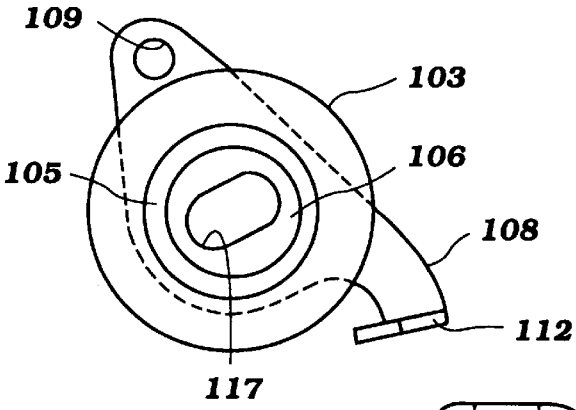
FIG. 15 is a view looking in the same direction as FIG. 14 showing only the idler pulley and its mounting arm.
Figure 14:
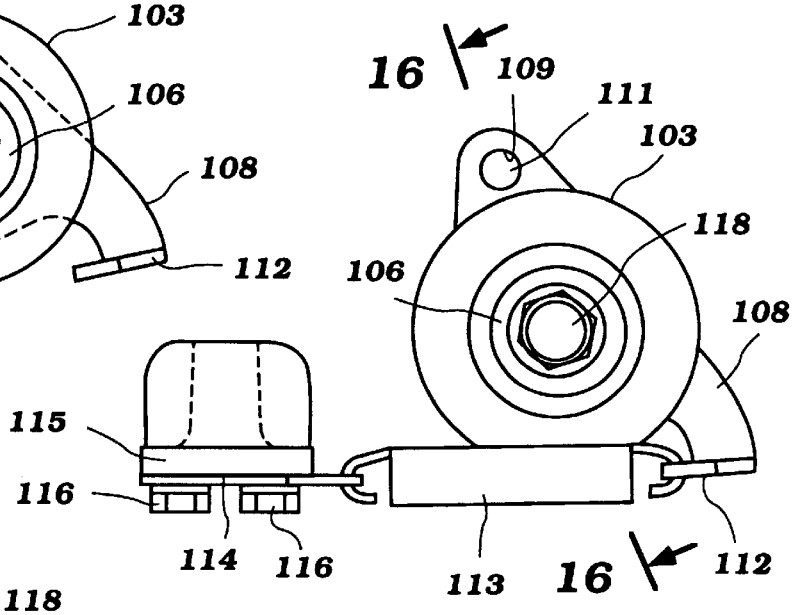
FIG. 14 is a view looking in the direction of the arrow 14 in FIG. 13.
Figure 16:
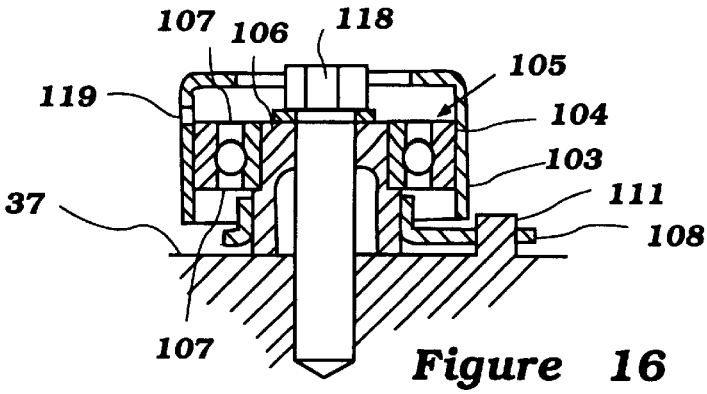
FIG. 16 is a cross-sectional view taken along the line 16—16 of FIG. 15.

FIGS. 11 and 12 show another embodiment which is basically the same as the embodiment of FIGS. 7–10. For that reason, components of this embodiment which are the same as the previously described embodiment have been identified by the same reference numerals and only a brief description of this embodiment is believed to be necessary to permit those skilled in the art to practice this embodiment.

In this embodiment, the main bearing caps 89 are extended radially outwardly and have shoulder portions at the outer periphery thereof against which the threaded fasteners 91 bear so as to provide a somewhat more compact arrangement.

The construction and operation of the belt tensioner 75 will now be described in detail by particular reference to FIGS. 13–16. The belt tensioner 75 is comprised of a non-tooth backup pulley 103 that is adapted to be engaged with the back or smooth side of the drive belt 65. This pulley 103 is mounted on the outer race 104 of a ball bearing assembly, indicated generally by the reference numeral 105 which is, in turn, mounted on a post 106. The ball bearings of the bearing assembly 105 are packed and grease held therein by retainer rings 107.

The post 106 is, in turn, fixed within a supporting lever 108. This supporting lever 108 has a first arm portion that defines an opening 109 so as to journal the lever on a pin 111 that is formed on or affixed to the upper face of the cylinder block 37. The outer end of the lever 108 is formed with an upturned tang 112 that is engaged by one end of a tension spring 113. The other end of the tension spring 113 is connected to a retainer plate 114 that is affixed to a projection 115 of the cylinder block 37 by means of threaded fasteners 116.

Finally, the hub or post 106 of the pulley 103 is formed with an arcuate slot 117 of a radius equal to the distance between the pin 111. A threaded fastener 118 is screwed in to the upper face of the cylinder block 37 and passes through the slot 117.

A small hole 119 is formed in the idler pulley 113 for two purposes. First, it permits any water to drain away from the bearing 105. In addition, by putting a tool into the opening 119 after loosening the fastener 118, the spring 113 may be extended so as to loosen the tension on the drive belt 65 sufficiently to replace it.

When the new belt is put into position, the spring is again pulled out and then released so as to set the appropriate tension on the drive belt 65. The fastener 118 is then tightened.

Figure 17:
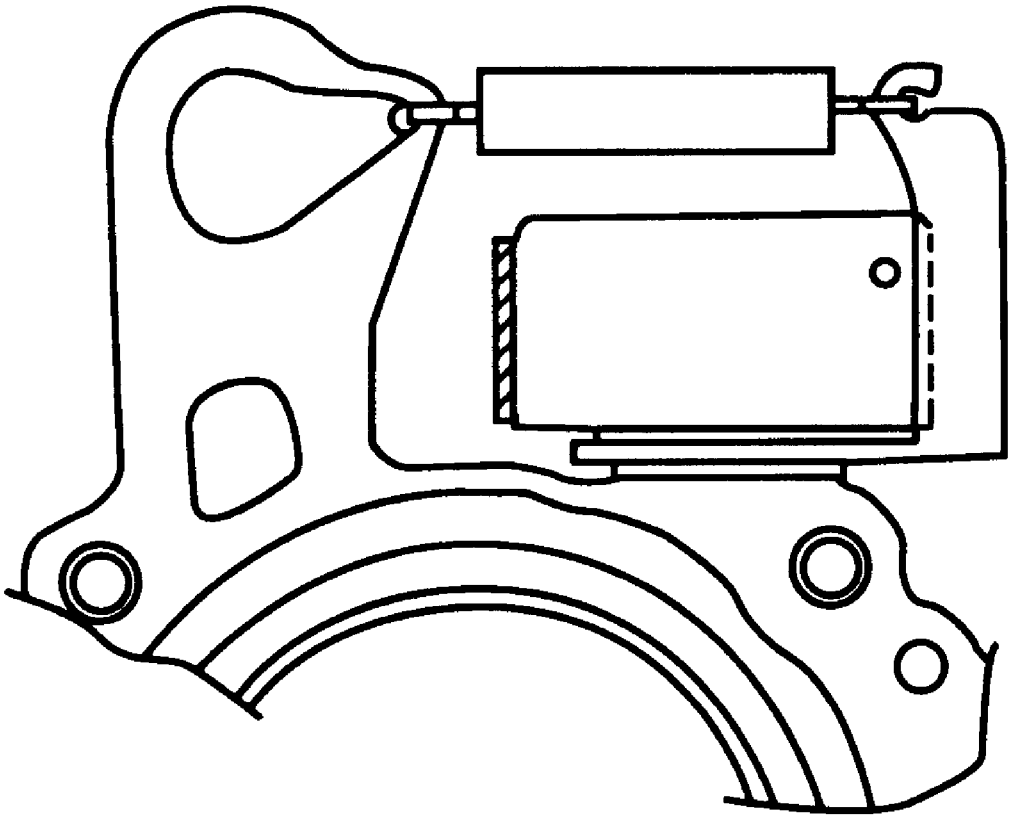
FIG. 17 is a reduced size view, in part similar to FIG. 13, and shows another embodiment of the invention.

FIG. 17 shows a slightly modified relationship wherein the spring attachment for the spring 113 is directly to a lug 121 formed on the engine body and which has an opening 122 so as to receive the end of the spring 113.

Thus, from the foregoing description, it should be readily apparent that the described embodiment of the invention provide a very effective and compact cam shaft drive arrangement that is particularly suited for outboard motors because of its compact nature and also because of its elimination of bending stresses on both the driven cam shaft and the driving crankshaft. Of course, the foregoing description is that of further embodiments of the invention and various changes and modifications may be made without departing from the spirit and scope of the invention, as defined by the appended claims.

We claim:

1. An internal combustion engine cam shaft drive arrangement, said engine having an engine body in which a crankshaft and at least one cam shaft are rotatably journaled, said crankshaft and said cam shaft both extending outwardly beyond one end face of said engine body, drive sprockets affixed to said extending portions of said cam shaft and said crankshaft for accommodating a flexible transmitter for transmitting drive therebetween, at least one of said drive sprockets extending axially relative to its respective shaft so that it axially overlies a main bearing for said one end of said respective shaft, said main bearing comprising a bearing surface formed directly in said engine body and a bearing cap rigidly affixed thereto and having a bearing surface cooperating with said engine body bearing surface for journalling said shaft, a cover affixed to said engine body and which cover encloses an opening through which said shaft can be removed, said the cover having a nose portion that extends into the interior of said at least one of said drive sprockets, and a seal carried by said nose portion and sealingly engaged with said bearing cap.

2. An internal combustion engine as set forth in claim 1 wherein the engine body includes a cylinder block that journals the crankshaft and a cylinder head affixed to the cylinder block and journalling the camshaft, and wherein the at least one of the drive sprockets is affixed to the camshaft.

3. An internal combustion engine as set forth in claim 2 wherein there is a second camshaft journaled in the cylinder head and driven by a drive sprocket that also extends axially relative to the second camshaft and overlies a main bearing for one end of said second camshaft.

4. An internal combustion engine as set forth in claim 3 wherein both of the camshafts are each journaled by a respective bearing surface formed directly in the engine body and a respective bearing cap rigidly affixed thereto and having a bearing surface cooperating with said engine body bearing surface for journalling said shaft.

5. An internal combustion engine as set forth in claim 4 wherein the cover encloses a common opening through which both of the camshafts can be removed.

6. An internal combustion engine as set forth in claim 5 wherein the cover has a further nose portion that extends into the interior of the drive sprocket for the second camshaft and which further nose portion carries a seal sealingly engaged with the bearing cap of the second camshaft.

7. An internal combustion engine as set forth in claim 1 , wherein the at least one of the drive sprockets is affixed relative to the camshaft and further including a flywheel affixed to the crankshaft outwardly of the drive sprocket affixed thereto.

8. An outboard motor including an internal combustion engine as set forth in claim 1, said outboard motor being comprised of a power head consisting of said engine and a surrounding protective cowling, a drive shaft housing and lower unit depending from said power head and containing a propulsion device for an associated watercraft and a transmission for driving said propulsion device from said engine, said engine being mounted in said power head so that the crankshaft and camshaft rotate about parallel, vertically extending axes.

9. An outboard motor as set forth in claim 8 wherein there is a second camshaft journaled in the cylinder head and driven by a drive sprocket that also extends axially relative to the second camshaft and overlies a main bearing for one end of said second camshaft.

10. An outboard motor as set forth in claim 9 wherein the camshafts are each journaled by a respective bearing surface formed directly in the engine body and a bearing cap rigidly affixed thereto and having a bearing surface cooperating with said engine body bearing surface for journalling said shaft.

11. An outboard motor as set forth in claim 10 wherein the cover encloses a common opening through which both of the camshafts can be removed.

12. An outboard motor as set forth in claim 11 wherein the cover has a further nose portion that extends into the interior of the drive sprocket for the second camshaft and which further nose portion carries a seal sealingly engaged with the bearing cap of the second camshaft.

13. An outboard motor as set forth in claim 8, wherein the at least one of the drive sprockets is affixed relative to the camshaft and further including a flywheel affixed to the crankshaft outwardly of the drive sprocket affixed thereto.

* * * * *